US006708972B2

(12) United States Patent
Ogita et al.

(10) Patent No.: US 6,708,972 B2
(45) Date of Patent: Mar. 23, 2004

(54) SHEET-LIKE OBJECT SORTER, AND DISCHARGED PAPER PROCESSING DEVICE FOR IMAGE-FORMING APPARATUS EMPLOYING THE SAME

(75) Inventors: Toshiki Ogita, Nara (JP); Shigeki Hayashi, Nara (JP); Naofumi Okada, Tenri (JP); Jinichi Nagata, Osaka (JP); Kiyoshi Tokishige, Kyoto (JP); Toyoaki Nanba, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 64 days.

(21) Appl. No.: 10/086,382

(22) Filed: Mar. 4, 2002

(65) Prior Publication Data

US 2002/0121734 A1 Sep. 5, 2002

(30) Foreign Application Priority Data

Mar. 5, 2001 (JP) ..... 2001-060537

(51) Int. Cl.[7] ..... B65H 29/58; B65H 39/10
(52) U.S. Cl. ..... 271/305; 271/297
(58) Field of Search ..... 271/297, 305

(56) References Cited

U.S. PATENT DOCUMENTS 4,228,996 A * 10/1980 Wilcox, Jr. ..... 271/297
4,555,106 A * 11/1985 Ruenzi ..... 271/297
5,013,028 A * 5/1991 Tajima et al. ..... 271/305
5,810,353 A * 9/1998 Baskette et al. ..... 271/305
6,206,369 B1 * 3/2001 Hoshii et al. ..... 271/290
6,257,572 B1 * 7/2001 Yamada et al. ..... 271/305

FOREIGN PATENT DOCUMENTS

JP 02062369 A * 3/1990 ..... B65H/31/30
JP 4-122557 U 11/1992

* cited by examiner

*Primary Examiner*—Christopher P. Ellis
*Assistant Examiner*—Mark A. Deuble
(74) *Attorney, Agent, or Firm*—Birch, Stewart, Kolasch & Birch, LLP

(57) ABSTRACT

A plurality of bin units are provided with respective gates and, hence, it is possible to sufficiently narrow the clearance between the gates and the bodies of the bin unit. When the gate provided at each bin unit is expanded to lie toward a conveying path, the front edge of the gate becomes put into a dent portion of a sidewall of an image-forming apparatus. For this reason, any clearance or protrusion causing jamming of recording paper is not formed in a branch path extending from the conveying path to a discharged paper tray through the gate and, hence, it is possible to guide recording paper from the conveying path into each bin unit by means of the gate smoothly.

17 Claims, 5 Drawing Sheets

SHEET-LIKE OBJECT SORTER, AND DISCHARGED PAPER PROCESSING DEVICE FOR IMAGE-FORMING APPARATUS EMPLOYING THE SAME

BACKGROUND OF THE INVENTION

1. Field of the Invention

The present invention relates to a sheet-like object sorter and a discharged paper processing device for image-forming apparatus employing the same. Specifically, the present invention relates to a discharged paper processing device which performs sorting of plain paper, transparent films for OHP or the like discharged mainly from an image-forming apparatus such as a printer or a copying machine, as well as to a sorter which sorts sheet-like objects fed thereto such as a sorter for sorting sheet-shaped pouches each containing medicine or food for example or a sorter for sorting post-cards or sealed letters.

2. Description of Related Art

In an image-forming apparatus such as a printer or a copying machine, there is optionally provided a discharged paper processing device which is removably attached to the image-forming apparatus and operates to sort a multiplicity of recording paper sheets on which recording has already been made. A typical discharged paper processing device does not have the function of conveying recording paper sheets from an image-forming apparatus or sorting such recording paper sheets and provides such functions on the image-forming apparatus side.

In "sorter" disclosed in Japanese Utility-Model Application Laid-Open No. 4-122557 (1992) for example, a conveying path for conveying recording paper and a plurality of branching guides for taking recording paper out of the conveying path are provided on the image-forming apparatus side, while a plurality of bins are removably attached to an image-forming apparatus, whereby any one of the branching guides leads recording paper to any one of the bins.

In the conventional "sorter" mentioned above having the branching guides provided on the image-forming apparatus side and the bins removably attached to the image-forming apparatus, however, the branching guides and the bins are separate members and, hence, a large clearance is formed between the branching guides and the bins and causes jamming of recording paper to take place during the conveyance from a bin to a branching guide. In addition, the conventional "sorter" adopts a structure which allows the bins to be easily removed for jammed recording paper to be removed, and this structure causes the clearance to be enlarged, making it difficult to prevent jamming of recording paper. Further, the conventional "sorter" mentioned above requires various sensors to be provided on the branch paths for detecting jamming of recording paper.

BRIEF SUMMARY OF THE INVENTION

Accordingly, the present invention has been made in view of the foregoing problems of the prior art, and it is an object of the present invention to provide a discharged paper processing device for image-forming apparatus with which jamming of recording paper is difficult to take place. It is another object of the present invention to provide a sorter with which jamming of sheet-like objects is difficult to take place.

In order to solve the foregoing problems, the present invention provides a sheet-like object sorter for sorting sheet-like objects discharged from a main apparatus and taking in the sorted sheet-like objects into a plurality of bin units, characterized in that: a bin unit assembly comprising a stack of the plurality of bin units is configured to be removably attached to a sidewall of the main apparatus; when the bin unit assembly is attached to the sidewall of the main apparatus, a conveying path for sheet-like objects is formed between a wall surface of the sidewall of the main apparatus to which the bin unit assembly is attached and an end portion of each of the bin units; and each of the bin units comprises a gate capable of selectively positioning a first position and a second position for taking in the sheet-like objects being conveyed on the conveying path, wherein when the gate positions at the first position, the conveying path is blocked to guide sheet-like objects being conveyed on the conveying path into each the bin unit, and when the gate positions at the second position, the conveying path is opened to allow sheet-like objects being conveyed on the conveying path to pass by.

The sheet-like object sorter of the above construction according to the present invention is provided with the gates on the bin unit assembly side for guiding sheet-like objects being conveyed on the conveying path into respective bin units. For this reason, any clearance causing jamming of sheet-like objects is not formed between the gates and the bin unit assembly and, hence, it is possible to guide such sheet-like objects from the conveying path to respective bin units through the gates smoothly. Further, since the conveying path is formed between the sidewall of the main apparatus and the end portions of the bin units forming the bin unit assembly, it is possible to put out and retract the gate provided at each bin unit relative to the conveying path easily. Moreover, since each gate is provided on a respective one of the bin units forming the bin unit assembly, the main apparatus can be simplified in structure.

The sheet-like object sorter of the present invention may have a feature wherein the bin units each comprises a tray for receiving sheet-like objects, and a conveyor roller for conveying sheet-like objects guided by the gate provided at each bin unit to the tray.

The sheet-like object sorter with this feature according to the present invention is capable of guiding sheet-like objects into each bin unit from the gate and then to the tray.

Further, the sheet-like object sorter of the present invention may have a feature wherein the bin units each comprises a driving unit controlled from the main apparatus so as to cause the gate to position one of the first position and the second position selectively.

The sheet-like object sorter with this feature according to the present invention allows the main apparatus to control putting out and retraction of the gate.

Yet, the sheet-like object sorter of the present invention may have a feature wherein dent portions into which a front edge portion of the gate provided at each of the bin units is put are formed on a sidewall of the main apparatus so that a front edge portion of the gate is put into a sidewall of the conveying path on the main apparatus side when the gate positions at the first position.

In such a sheet-like object according to the present invention, when the front edge of the gate is put into the dent portion formed on the sidewall of the main apparatus, any clearance or protrusion causing jamming of sheet-like objects is not formed between the front edge of the gate and the sidewall of the main apparatus and, hence, it is possible to guide sheet-like objects from the conveying path into each bin unit by means of the gate smoothly.

Further, the sheet-like object sorter of the present invention may have a feature wherein: each of the bin units comprises a driven conveyor roller at an end portion thereof, the main apparatus has a driving conveyor roller on the sidewall thereof, the driving conveyor roller contact with the driven conveyor roller provided at each bin unit when the bin unit assembly is attached to the main apparatus; and sheet-like objects are conveyed while being caught between the driving conveyor roller and the driven conveyor roller.

In the sheet-like object sorter with this feature according to the present invention, the driven conveyor rollers for conveying sheet-like objects along the conveying path are provided on the bin unit side and, hence, the structure of the main apparatus can be simplified.

Yet, the sheet-like object sorter of the present invention may have a feature wherein: the driven conveyor roller and the driving conveyor roller comprises at least one pair, respectively; and space of the at least one pair of driven conveyor rollers and space of the one pair of driving conveyor rollers are set equal to or smaller than the width of a sheet-like object of a minimum size to be discharged from the main apparatus, respectively.

The sheet-like object sorter with this feature according to the present invention is capable of catching opposite side edges of a sheet-like object of a minimum size between the driven conveyor rollers and the driving conveyor rollers, whereby even sheet-like objects of a minimum size can be conveyed straight and sorted.

In order to solve the foregoing problems, the present invention also provides a discharged paper processing device for image-forming apparatus for sorting paper sheets discharged from the image-forming apparatus and taking in the sorted paper sheets into a plurality of bin units, characterized in that: a bin unit assembly comprising a stack of the plurality of bin units is configured to be removably attached to a sidewall of the image-forming apparatus; when the bin unit assembly is attached to the sidewall of the image-forming apparatus, a conveying path for discharged paper sheets is formed between a wall surface of the sidewall of the image-forming apparatus to which the bin unit assembly is attached and an end portion of each of the bin units; and each of the bin units comprises a gate capable of selectively positioning a first position and a second position for taking in the discharged paper sheets being conveyed on the conveying path, wherein when the gate positions at the first position, the conveying path is blocked to guide discharged paper sheets being conveyed on the conveying path into each bin unit, and when the gate positions at the second position, the conveying path is opened to allow discharged paper sheets being conveyed on the conveying path to pass by.

The discharged paper processing device for image-forming apparatus of the above construction according to the present invention is provided with the gates on the bin unit assembly side. For this reason, any clearance causing jamming of recording paper is not formed between the gates and the bin unit assembly and, hence, it is possible to guide recording paper sheets from the conveying path to respective bin units through the gates smoothly. Further, since the conveying path is formed between the sidewall of the image-forming apparatus and the end portions of the bin units forming the bin unit assembly, it is possible to put out and retract the gate provided at each bin unit relative to the conveying path easily. Moreover, since each gate is provided on a respective one of the bin units forming the bin unit assembly, the image-forming apparatus can be simplified in structure.

The discharged paper processing device for image-forming apparatus of the present invention may have a feature wherein the bin units each comprises a tray for receiving discharged paper sheets, and a conveyor roller for conveying discharged paper sheets guided by the gate provided at each bin unit to the tray.

The discharged paper processing device for image-forming apparatus with this feature according to the present invention is capable of guiding recording paper sheets into each bin unit by means of the gate and then to the tray.

Further, the discharged paper processing device for image-forming apparatus of the present invention may have a feature wherein the bin units each comprises a driving unit controlled from the image-forming apparatus so as to cause the gate to position one of the first position and the second position selectively.

The discharged paper processing device for image-forming apparatus with this feature according to the present invention allows the image-forming apparatus to control putting out and retraction of the gate.

Yet, the discharged paper processing device for image-forming apparatus of the present invention may have a feature wherein the bin units each comprises a tray for receiving discharged paper sheets, and a conveyor roller for conveying discharged paper sheets guided by the gate provided at each bin unit to the tray.

In such a discharged paper processing device for image-forming apparatus according to the present invention, when the front edge of the gate is put into the dent portion formed on the sidewall of the image-forming apparatus, any clearance or protrusion causing jamming of recording paper is not formed between the front edge of the gate and the sidewall of the image-forming apparatus and, hence, it is possible to guide recording paper from the conveying path into each bin unit by means of the gate smoothly.

Further, the discharged paper processing device for image-forming apparatus of the present invention may have a feature wherein: each of the bin units comprises a driven conveyor roller at an end portion thereof, the image-forming apparatus has a driving conveyor roller on the sidewall thereof, the driving conveyor roller contacting with the driven conveyor roller provided at each bin unit when the bin unit assembly is attached to the image-forming apparatus; and discharged paper sheets are conveyed while being caught between the driving conveyor roller and the driven conveyor roller.

In the discharged paper processing device for image-forming apparatus with this feature according to the present invention, the driven conveyor rollers for conveying recording paper sheets along the conveying path are provided on the bin unit side and, hence, the structure of the main apparatus can be simplified.

Yet further, the discharged paper processing device for image-forming apparatus of the present invention may have a feature wherein: the driven conveyor roller and the driving conveyor roller comprises at least one pair, respectively; and space of the at least one pair of driven conveyor rollers and space of the one pair of driving conveyor rollers are set equal to or smaller than the width of a paper sheet of a minimum size to be discharged from the image-forming apparatus, respectively.

The discharged paper processing device for image-forming apparatus with this feature according to the present invention is capable of catching opposite side edges of a recording paper sheet of a minimum size between the driven conveyor rollers and the driving conveyor rollers, whereby even recording paper sheets of a minimum size can be conveyed straight and sorted.

The above and further objects and features of the invention will more fully be apparent from the following detailed description with accompanying drawings.

DETAILED DESCRIPTION OF THE PREFERRED EMBODIMENTS

Hereinafter, embodiments of the present invention will be described in detail with reference to the accompanying drawings. While the following description is directed to the case where a sheet-like object sorter according to the present invention is applied mainly to a discharged paper processing device for image-forming apparatus such as a copying machine, printer and facsimile apparatus, paper discharged in this case includes not only typical plain paper but also transparent films for OHPs and the like. It is needless to say that the sheet-like object sorter of the present invention is also applicable to devices for conveying and sorting sheet-like objects such as a device for conveying and sorting sheet-shaped pouches each containing medicine or food for example or a conveyer for sorting postcards or sealed letters.

Figure 1:
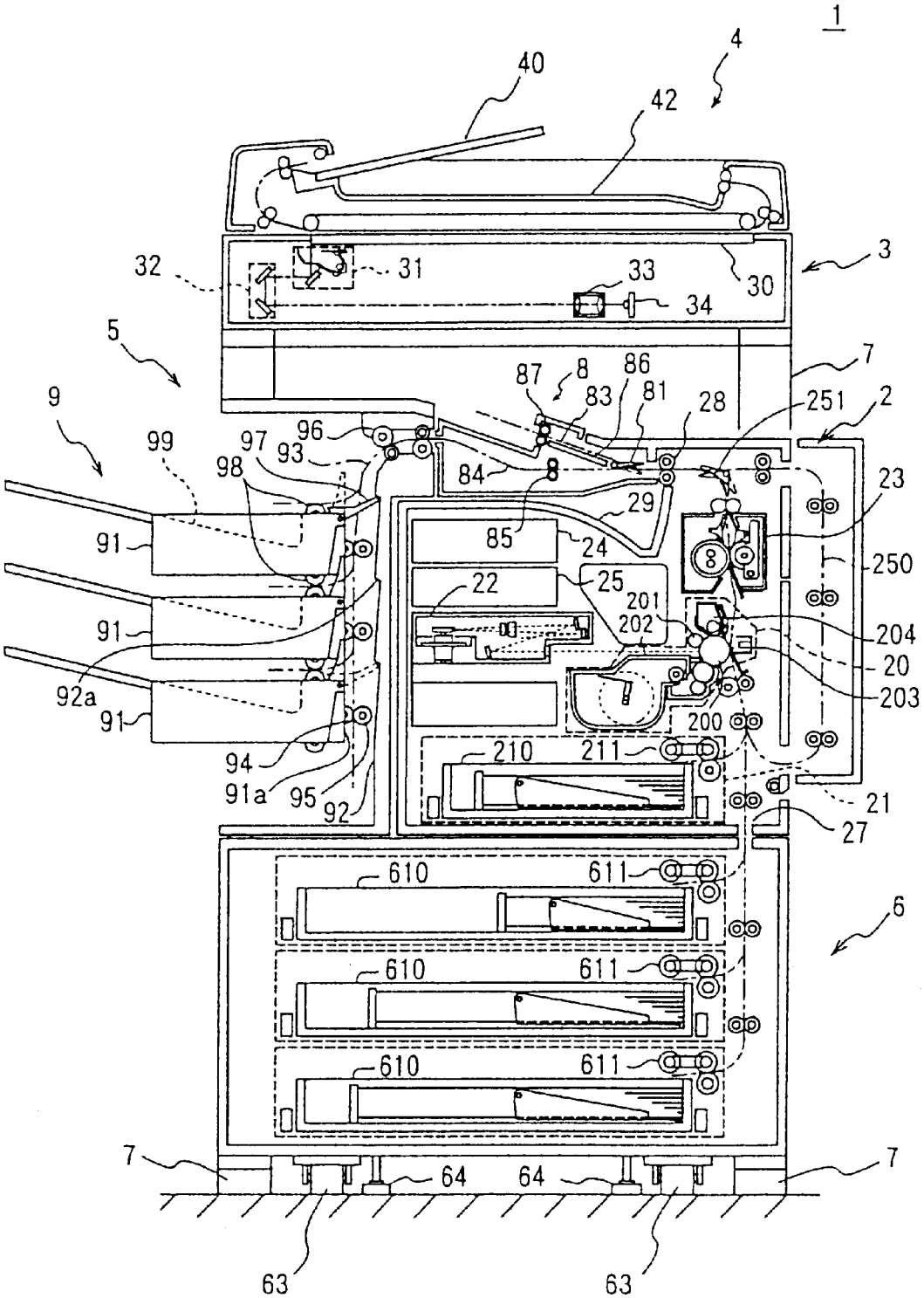
FIG. 1 is a side elevational view showing one embodiment of the present invention in which a sheet-like object sorter according to the invention is applied to a discharged paper processing device for image-forming apparatus.

FIG. 1 is a side elevational view showing one embodiment of the present invention in which a sheet-like object sorter according to the invention is applied to a discharged paper processing device for image-forming apparatus. The image-forming apparatus 1 shown in FIG. 1 is of the type fulfilling multiple functions such as the functions of copying machine, printer, facsimile apparatus and the like. The image-forming apparatus 1 comprises a printer 2, a scanner 3 and an automatic document feeder 4 and is provided with a discharged paper processing device 5 and a multi-stage paper feeder 6 as optional components.

When an original document is placed on a document set tray 40, the automatic document feeder 4 feeds and positions the original document onto a platen glass 30, and after the scanner 3 has read the image of the original document, the feeder 4 conveys the original document to an original document discharged tray 42. The automatic document feeder 4 is pivotally supported at one side thereof so that the entire feeder 4 can open and close to allow an unfeedable original document to be placed on the platen glass 30.

With respect to the scanner 3, one of an automatic read mode and a manual operation read mode is selected to set the operational mode of the scanner 3. When the automatic read mode is selected, the scanner 3 reads the image of an original document in cooperation with the document feeder 4 feeding the original document onto the platen glass 30. On the other hand, when the manual operation read mode is selected, the scanner 3 reads the image of an original document placed on the platen glass 30 in response to a manual operation by the user. In either mode, first and second scanning units 31 and 32 move with a predetermined velocity relationship therebetween maintained; the image of the original document placed on the platen glass 30 is exposed by the first scanning unit 31; light reflected from the original document is guided to a lens 33 by the first and second scanning units 31 and 32;

and the image of the original document is image-formed on a photoelectric conversion device (CCD) 34 through the lens 33. The CCD 34 reads the image of the original document by repeated scanning in the primary scanning direction and outputs image data representing the image of the original document.

The printer 2, to which image data from the scanner 3 or from an external device (a personal computer for example) is inputted, records the image represented by the image data on recording paper.

A printer control unit 24 controls an electro-photographic process unit 20 and functions as an interface for receiving image data from the external device. An image control unit 25 performs predetermined image processing of image data fed from the external device and controls and drives the operation of a light scanning unit 22 according to the image data.

The electro-photographic process unit 20 comprises a photosensitive drum 200, an electro static charging roller 201, light scanning unit 22, a developing unit 202, a transfer unit 203, a cleaning unit 204, an electro static eliminator unit (not shown), and the like. The photosensitive drum 200 rotates in one direction. The electro static charging roller 201 causes the photosensitive drum 200 to be electrostatically charged uniformly. The light scanning unit 22 forms a light beam (light image) modulated according to image data and performs repeated scanning over the surface of the photosensitive drum 200 in the primary scanning direction using the light beam to form an electrostatic latent image on the surface of the photosensitive drum 200. The developing unit 202 supplies toner to the surface of the photosensitive drum 200. The toner adheres to the electrostatic latent image on the surface of the photosensitive drum 200 to form a toner image. The transfer unit 203 superposes recording paper fed from below on the photosensitive drum 200 to cause the toner image to transfer from the photosensitive drum 200 to the recording paper. The cleaning unit 204 removes toner remaining on the surface of the photosensitive drum 200. The electro static eliminator unit eliminates the static charge on the surface of the photosensitive drum 200.

A fixing device 23 is disposed above the electro-photographic process unit 20. The fixing device 23 fixes the toner image to the recording paper by heating and pressurizing the recording paper.

The recording paper is further conveyed by discharge rollers 28 and passed to a relay path unit 8 of the discharged paper processing unit 5.

When recording of an image is to be made also on the reverse side of the recording paper, the conveyance of the recording paper is temporarily stopped, and then the recording paper is conveyed in the opposite direction from the relay path unit 8 to the printer 2. At the printer 2, a branching pawl 251 is rotated to guide the recording paper to a reversing conveying path 250 through which the recording paper is conveyed to the electro-photographic process 20 again, whereby the recording paper is turned upside down to allow the image to be recorded on the reverse side thereof. The recording paper having thus recorded the images on the both sides thereof is conveyed by the discharge rollers 28 and passed to the relay path unit 8 of the discharged paper processing device 5.

Below the printer 2 is disposed a paper feeding unit 21. The paper feeding unit 21 includes a paper storage tray 210 storing therein recording paper sheets in a stacked fashion and a separating and feeding unit 211 which picks up recording paper sheets one by one from the paper storage tray 210 while separating one sheet from the rest and feeds them to the electro-photographic process unit 20. The recording paper is conveyed to the transfer unit 203, passed through the fixing device 23 and then conveyed to the discharge rollers 28. Incidentally, it is possible to draw the paper storage tray 210 out of the body of the image-forming apparatus 1 and replenish the paper storage tray 210 in a drawn-out state with recording paper.

The multi-stage paper feeder 6 is an optional component which is removably attached to the image-forming apparatus 1. The multi-stage paper feeder 6 stores plural kinds of recording paper in respective paper storage trays 610. Separating and feeding units 611 each take recording paper sheets out of respective one of the paper storage trays 610 while separating one sheet from the rest and send them to the electro-photographic process unit 20 through a paper receiving port 27 of the printer 2. Incidentally, it is possible to draw each of the paper storage trays 610 out of the body of the multi-stage paper feeder 6 and replenish each paper storage tray 610 in a drawn-out state with recording paper. The number and sizes of the paper storage trays may be changed appropriately.

The multi-stage paper feeder 6 carries thereon the printer 2 and the discharged paper processing device 5 as an optional component. On the other hand, the scanner 3 and the automatic document feeder 4 rest on a system rack 7. At the bottom of the multi-stage paper feeder 6 are provided moving rollers 63 and fixing portions 64. When the fixing portions 64 are spaced apart from the floor surface by being screwed into the bottom of the multi-stage paper feeder 6 thereby having the moving rollers 63 support the multi-stage paper feeder 6, it is possible to move the multi-stage paper feeder 6. In this state, the multi-stage paper feeder 6, printer 2 and discharged paper processing device 5 are moved so as to be arranged inside the system rack 7. Thereafter, the fixing portions 64 are rotated to project until they contact with the floor surface thereby fixing the multi-stage paper feeder 6 by means of the fixing portions 64. At this time, a space is formed between the relay path unit 8 of the discharged paper processing device 5 and the scanner 3.

The discharged paper processing device 5 is an optional component which is removably attached to the body of the image-forming apparatus 1 and comprises the relay path unit 8 and a post-processing unit 9.

The relay path unit 8 has a relay path 84 for receiving recording paper from the printer 2 and conveying it to the post-processing unit 9, a switch-back path 83 for temporarily receiving recording paper and returning it to the printer 2, and a gate plate 81 for guiding recording paper fed from the printer 2 to the relay path 84 or the switch-back path 83. The gate plate 81 can swing. When the front edge of the gate plate 81 is oriented downward, recording paper is guided to the relay path 84, while when the same is oriented upward, recording paper is guided to the switch-back path 83.

The relay path 84 is provided with conveyor rollers 85 which rotate in one direction for guiding recording paper to the post-processing unit 9. The switch-back path 83 is provided with a carrier plate 86 on which recording paper is placed and conveyor rollers 87 which are rotatable forwardly and backwardly. Not only the conveyor rollers 87 but also the conveyor rollers 28 of the printer 2 are rotatable forwardly and backwardly. When a recording paper sheet is guided to the switchback path 83, the trailing edge of the recording paper sheet is caught between the conveyor rollers 28 of the printer 2, and the conveyor rollers 87 and conveyor rollers 28 are stopped with the recording paper in a state placed on the carrier plate 86 to stop the conveying of the recording paper temporarily. Thereafter, the recording paper is conveyed to the printer 2 in the opposite direction by rotating the conveyor rollers 87 and conveyor rollers 28 backwardly. At the printer 2, the branching pawl 251, as described earlier, guides the recording paper to the reversing conveying path 250, through which the recording paper is conveyed to the electro-photographic process 20 where an image is recorded on the reverse side of the recording paper.

The post-processing unit 9 receives recording paper from the printer 2 through the relay path 84 and performs post-processing with respect to the recording paper. Such post-processing includes stapling, sorting and the like.

The post-processing unit 9 of the discharged paper processing device 5 according to this embodiment will be more specifically described below. The post-processing unit 9 in this embodiment is formed as an assembly of plural bin units 91, each bin unit 91 capable of being removably attached to the image-forming apparatus 1. A conveying path 93 is formed between an end portion 91*a* of each bin unit 91 and a sidewall 92 of the image-forming apparatus 1. Each bin unit 91 is provided with driven conveyor rollers 94 at the end portion 91*a* thereof, while the image-forming apparatus 1 is provided with driving conveyor rollers 95 at the sidewall 92 thereof. The driven conveyor rollers 94 and the counterpart driving conveyor rollers 95 are pressed against each other and, hence, the driven conveyor rollers 94 are driven to rotate by the counterpart driving conveyor rollers 95 rotating. At the post-processing unit 9, recording paper from the relay path unit 8 is guided to the conveying path 93 by means of the conveyor rollers 96 and then conveyed along the conveying path 93 by means of the driven conveyor rollers 94 and driving conveyor rollers 95.

Each bin unit 91 is provided with a gate 97 and upper and lower paper discharge rollers 98. The gate 97 and the upper and lower paper discharge rollers 98 are driven by the image-forming apparatus 1. The gate 97 is pivotally supported so as to put out and retract relative to the conveying path 93. When the gate 97 is put out to lie toward the conveying path 93, it takes in recording paper from the conveying path 93. The upper and lower paper discharge rollers 98 of each bin unit 91 are pressed against paper discharge rollers 98 of vertically adjacent bin units 91, one roller driving the other roller to convey the recording paper taken in from the conveying path 93 by the gate 97 toward a discharged paper tray 99.

When a copy mode for example is set, the image-forming apparatus 1 causes the gate 97 of only an upper row bin unit 91 to put out to lie toward the conveying path 93 in order to guide recording paper from the conveying path 93 toward the discharged paper tray 99 of the upper row bin unit 91 through the gate 97. Alternatively, when a print mode is set, the image-forming apparatus 1 causes the gate 97 of only a middle row bin unit 91 to put out to lie toward the conveying path 93 in order to guide recording paper from the conveying path 93 toward the discharged paper tray 99 of the middle row bin unit 91 through the gate 97. Likewise, when a facsimile mode is set, the image-forming apparatus 1 causes the gate 97 of only a lower row bin unit 91 to put out to lie toward the conveying path 93 in order to guide recording paper from the conveying path 93 toward the discharged paper tray 99 of the lower row bin unit 91 through the gate 97.

Each gate 97 is provided on respective bin unit 91 side. For this reason, the clearance between the gate 97 and the body of the bin unit 91 can be set sufficiently narrow and, hence, any clearance causing jamming of recording paper is not formed in the branch path extending from each gate 97 to its associated discharged paper tray 99.

When the gate 97 of each bin unit 91 is put out to lie toward the conveying path 93, the front edge of the gate 97 is put into a dent portion 92*a* of the sidewall 92 of the image-forming apparatus 1. For this reason, any clearance and/or any protrusion causing jamming of recording paper are not formed between the front edge of the gate 97 and the sidewall 92 and, hence, it is possible to guide recording paper into each bin unit 91 by means of the gate 97 and then to the associated discharged paper tray 99 smoothly.

It is to be noted that the number of bin units 91 to be attached, stated otherwise the number of bin units 91 forming the bin unit assembly, is optional and hence can be appropriately determined for the convenience of the user.

Figure 2:
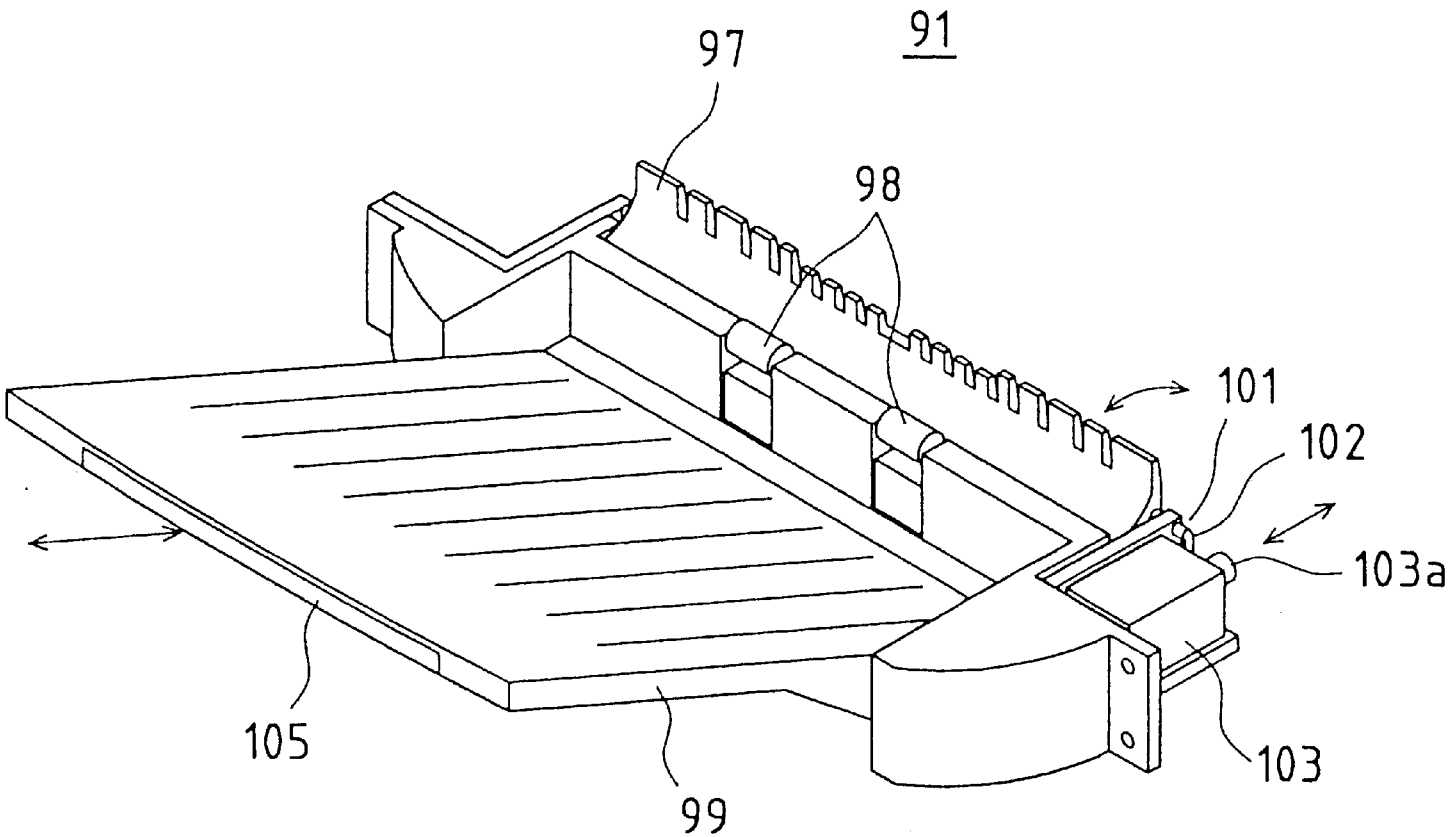
FIG. 2 is a perspective view showing a bin unit of the discharged paper processing device shown in FIG. 1 as viewed from the front side.
Figure 3:
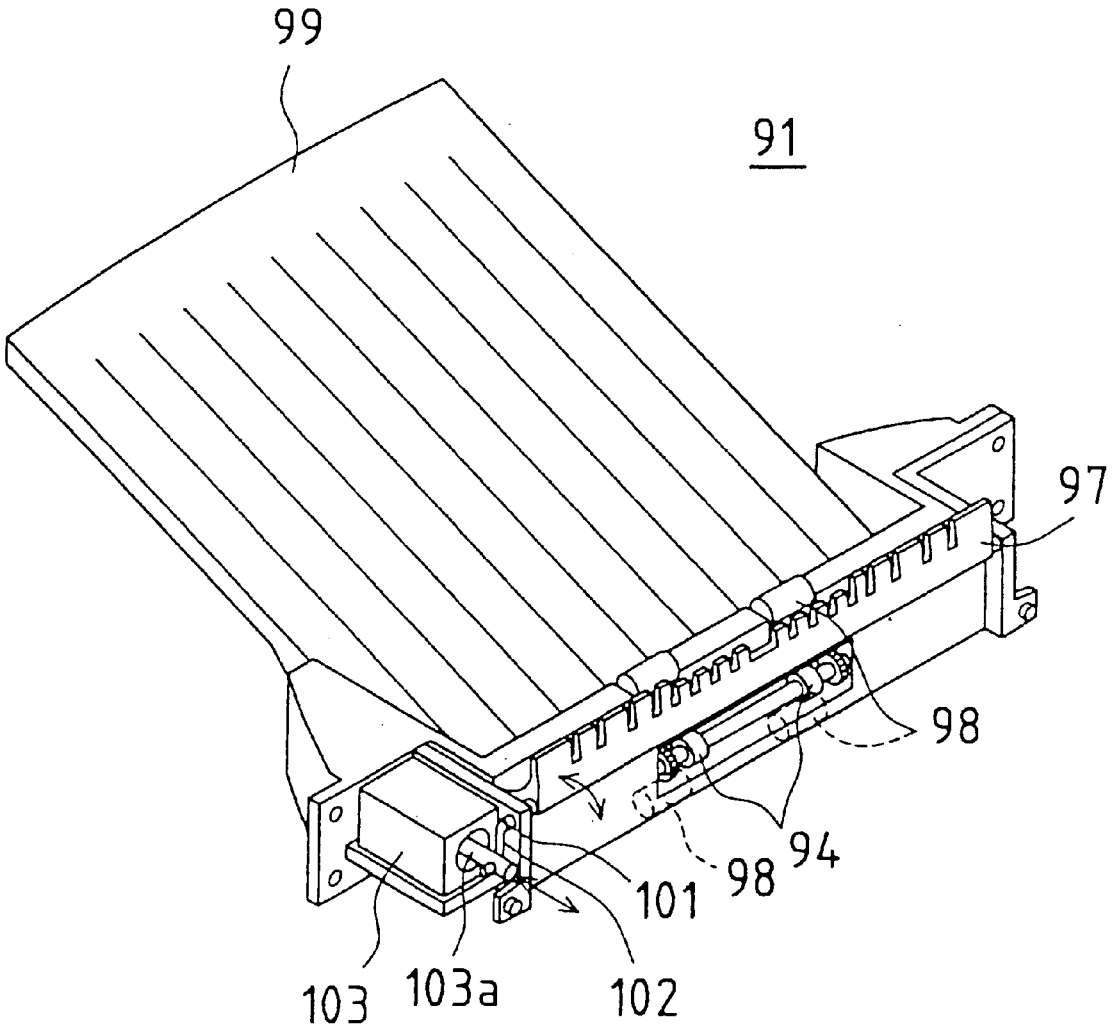
FIG. 3 is a perspective view showing the bin unit of the discharged paper processing device shown in FIG. 1 as viewed from the rear side.

FIG. 2 is a perspective view showing a bin unit 91 as viewed from the front side, while FIG. 3 is a perspective view showing the bin unit 91 as viewed from the rear side. As apparent from FIG. 2 and FIG. 3, the gate 97 is pivotally supported at a rear portion of each bin unit 91 and connects a shaft 101 thereof to a plunger 103*a* of a solenoid 103 via a crank 102. The solenoid 103 is driven and controlled by the image-forming apparatus 1 and acts to move the plunger 103*a*. When the plunger 103*a* is in a protruded position, the gate 97 stands substantially vertically on the bin unit 91 side, while when the plunger 103*a* is retracted, the gate 97 is put out to lie toward the conveying path 93, so that the front edge thereof is put into the dent portion 92*a* of the sidewall 92 of the image-forming apparatus 1.

A portion adjacent the front edge of the gate 97 is formed in a comb-like shape. This comb-like shape front edge is accommodated in a space formed at a rear portion of another bin unit 91 disposed just above when the gate 97 stands substantially vertically on the bin unit 91 side.

A pair of driven conveyor rollers 94 are rotatably supported on a shaft at the end portion 91*a* of each bin unit 91. Paper discharge rollers 98 are rotatably supported on respective shafts at upper and lower sides of each bin unit 91.

The discharged paper tray 99 of each bin unit 91 is provided with a slide plate 105 which can be drawn out and pushed in. When recording paper size is larger than the discharged paper tray 99, the slide plate 105 is drawn out.

Figure 4:
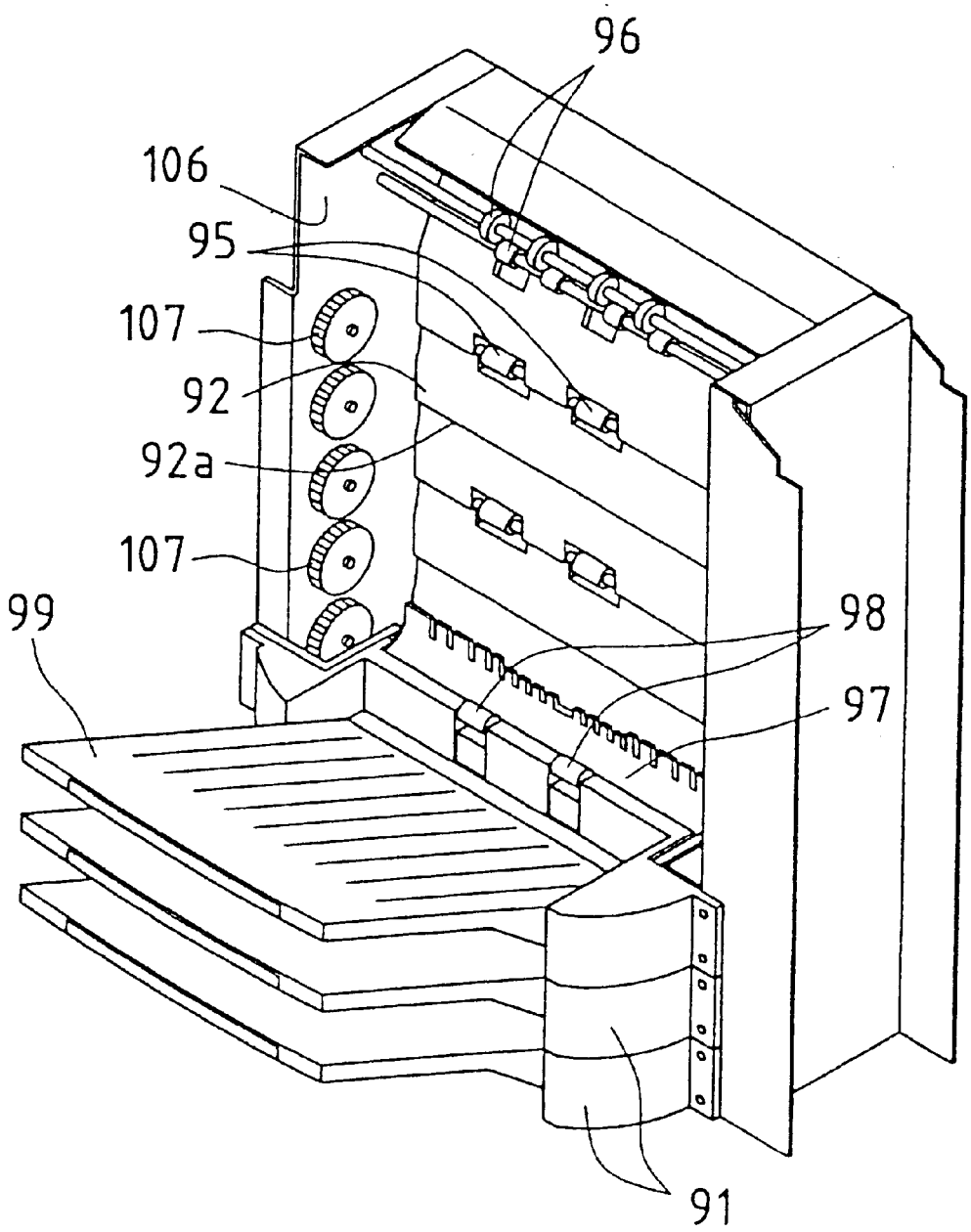
FIG. 4 is a perspective view showing a portion around a sidewall of the image-forming apparatus to which each bin unit of the discharged paper processing device showing in FIG. 1 is attached.

FIG. 4 shows a portion around the sidewall 92 of the image-forming apparatus 1 to which each bin unit 91 is attached. As apparent from FIG. 4, plural pairs of driving conveyor rollers 95 are provided on the sidewall 92 of the image-forming apparatus 1. One pair of driving conveyor rollers 95 are pressed against the pair of driven conveyor rollers 94 of one bin unit 91. Respective spaces of one pair of driving conveyor rollers 95 and that of one pair of driven conveyor rollers 94 are set so that both side edges of a recording paper sheet of a minimum size that can be processed by the image-forming apparatus 1 can be caught between the driven conveyor rollers 94 and the driving conveyor rollers 95. Thus, even recording paper sheets of a minimum size can be conveyed straight and sorted.

At the side wall 92 of the image-forming apparatus 1, the dent portions 92*a* into each of which the gate 97 of each bin unit 91 becomes put into are formed.

Further, both side walls 106 on opposite sides of the sidewall 92 are provided with disc-shaped guide members 107 for positioning respective bin units 91.

Figure 5:
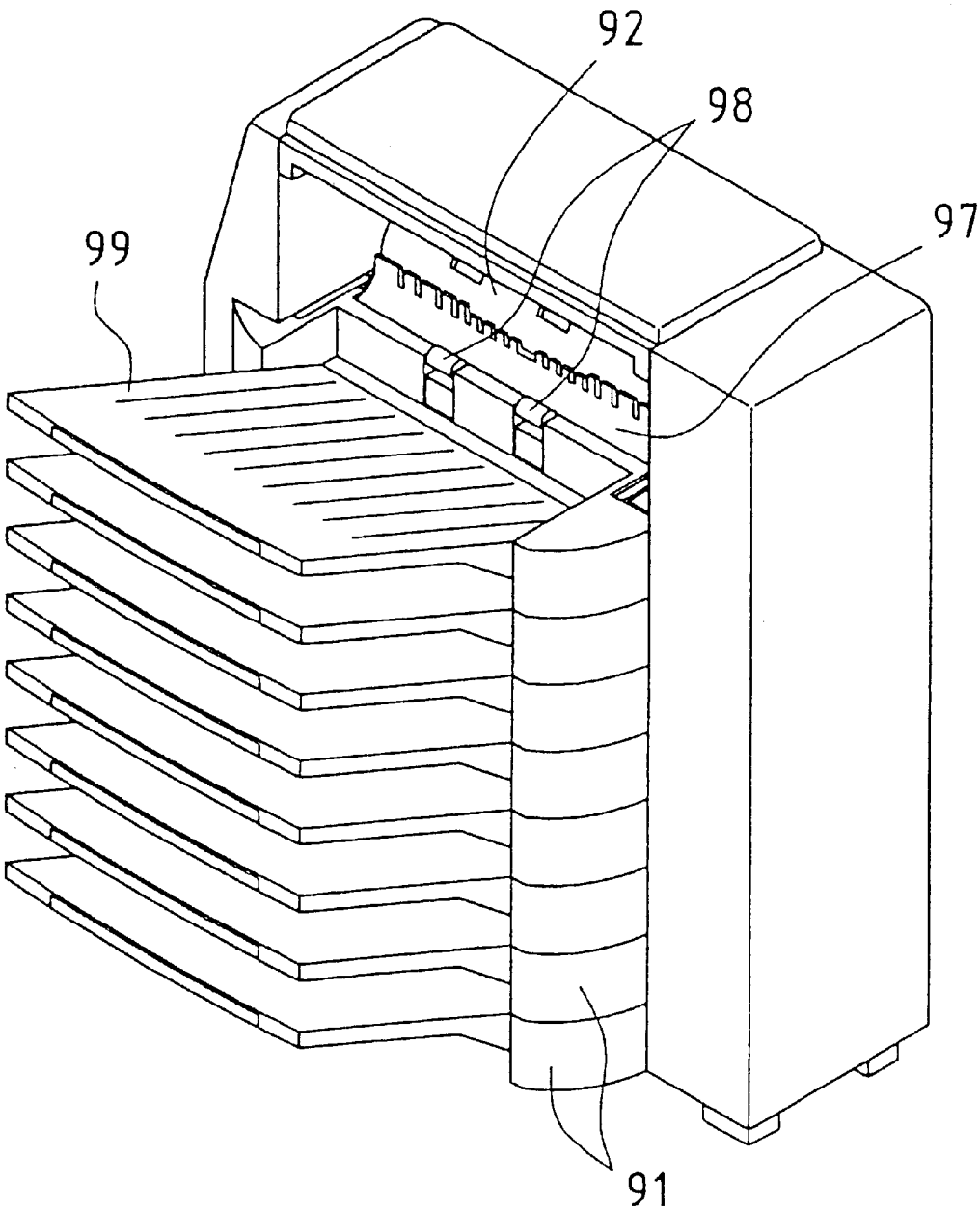
FIG. 5 is a perspective view showing a state where the maximum number of bin units of the discharged paper processing device are attached to the image-forming apparatus.

Here, the bin units 91 are stacked from the lower side for ease of showing the structure of the sidewall 92 of the image-forming apparatus 1. Usually, however, bin units 91 in any desired number are stacked in a descending order. FIG. 5 shows a state where a maximum number of bin units 91 are attached to the image-forming apparatus 1.

Since the discharged paper processing device 5 according to the embodiment has the gates 97 each provided on respective bin unit 91 side, it is possible to sufficiently narrow the clearance between the gates 97 and the bodies of the bin units 91. When the gate 97 of each bin unit 91 is put out to lie toward the conveying path 93, the front edge of the gate 97 puts into respective dent portion 92*a*. For this reason, any clearance causing jamming of recording paper is not formed in the branch path extending from the conveying path 92 to the discharged paper tray 99 through the gate 97 and, hence, it is possible to guide recording paper into each bin unit 91 by means of the gate 97 and then to the discharged paper tray 99 smoothly. Further, it is possible to reduce the number of sensors for detecting jamming of recording paper.

As has been specifically described above, the sheet-like object sorter of the present invention has the gates provided on the bin unit assembly side. For this reason, any clearance causing jamming of sheet-like objects is not formed between the gates and the bin unit assembly and, hence, it is possible to guide such sheet-like objects from the conveying path to respective bin units through the gates smoothly.

Further, since the conveying path is formed between the sidewall of the main apparatus and the end portions of the bin units forming the bin unit assembly, it is possible to put out and retract the gate provided at each bin unit relative to the conveying path easily. Moreover, since each gate is provided at a respective one of the bin units forming the bin unit assembly, the main apparatus can be simplified in structure.

Further, the sheet-like object sorter of the present invention is capable of guiding sheet-like objects into each bin unit from the gate and then to the tray.

Yet, the sheet-like object sorter of the present invention allows the main apparatus side to control putting out and retracting the gate.

Further, according to the sheet-like object sorter of the present invention, when the front edge of the gate puts into the dent portion formed on the sidewall of the main apparatus, any clearance or protrusion causing jamming of sheet-like objects is not formed between the front edge of the gate and the sidewall of the main apparatus and, hence, it is possible to guide sheet-like objects from the conveying path into each bin unit by means of the gate smoothly.

Yet, in the sheet-like object sorter of the present invention, the driven conveyor rollers for conveying sheet-like objects along the conveying path are provided on the bin unit side and, hence, the structure of the main apparatus can be simplified.

Further, the sheet-like object sorter of the present invention is capable of catching opposite side edges of a sheet-like object of a minimum size between the driven conveyor rollers and the driving conveyor rollers, whereby even sheet-like objects of a minimum size can be conveyed straight and sorted.

As has been described above, the discharged paper processing device for image-forming apparatus of the present invention has the gates provided on the bin unit assembly side. For this reason, any clearance causing jamming of recording paper is not formed between the gates and the bin unit assembly and, hence, it is possible to guide recording paper sheets from the conveying path to respective bin units through the gates smoothly. Further, since the conveying path is formed between the sidewall of the image-forming apparatus and the each end portion of the bin unit forming the bin unit assembly, it is possible to put out and retract the gate provided at each bin unit relative to the conveying path. Moreover, since each gate is provided at a respective one of the bin units forming the bin unit assembly, the image-forming apparatus can be simplified in structure.

Further, the discharged paper processing device for image-forming apparatus of the present invention is capable of guiding recording paper sheets into each bin unit by means of the gate and then to the tray.

Yet, the discharged paper processing device for image-forming apparatus of the present invention allows the image-forming apparatus side to control putting out and retracting the gate.

According to the discharged paper processing device for image-forming apparatus of the present invention, when the front edge of the gate puts into the dent portion formed on the sidewall of the image-forming apparatus, any clearance or protrusion causing jamming of recording paper is not formed between the front edge of the gate and the sidewall of the image-forming apparatus and, hence, it is possible to guide recording paper from the conveying path into each bin unit by means of the gate smoothly.

Further, in the discharged paper processing device for image-forming apparatus of present invention, the driven conveyor rollers for conveying recording paper sheets along the conveying path are provided on the bin unit side and, hence, the structure of the main apparatus can be simplified.

Yet further, the discharged paper processing device for image-forming apparatus of the present invention is capable of catching opposite side edges of a recording paper sheet of a minimum size between the driven conveyor rollers and the driving conveyor rollers, whereby even recording paper sheets of a minimum size can be conveyed straight and sorted.

The foregoing description is directed to the case where the sheet-like object sorter of the present invention is applied mainly to the discharged paper processing device for image-forming apparatus such as a copying machine, printer and facsimile apparatus for conveying and sorting sheet-like objects, specifically plain paper, transparent films for OHPs, and the like, by means of plural guide members. However, it is needless to say that the sheet-like object sorter of the present invention is also applicable to a wide variety of sorters for devices adapted to convey sheet-like objects such as a device for conveying sheet-shaped pouches each containing medicine or food for example or an apparatus for conveying and sorting postcards or sealed letters.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A sheet object sorter for sorting sheet objects discharged from a main apparatus and taking in the sorted sheet objects into a plurality of bin units, comprising:

a stack of said plurality of bin units removably attached to a sidewall of said main apparatus;

when said bin units are attached to the sidewall of said main apparatus, a surface of a conveying path for the sheet objects is formed solely by a wall surface of the sidewall of said main apparatus to which said bin units are attached and an end portion of each of the bin units; and each of said bin units being capable of individual attachment and each includes a gate capable of selectively positioning to a first position and to a second position for taking in the sheet objects being conveyed on said conveying path, wherein when said gate positions at said first position, said conveying path is blocked to guide sheet objects being conveyed on said conveying path into each bin unit, and when said gate positions at said second position, said conveying path is opened to allow sheet objects being conveyed on the conveying path to pass by.

2. The sheet object sorter as set forth in claim 1, wherein said bin units each comprises a tray for receiving sheet objects, and a conveyor roller for conveying sheet objects guided by said gate provided at each bin unit to said tray.

3. The sheet object sorter as set forth in claim 1, wherein said bin units each comprises a driving unit capable of being controlled so as to cause said gate to position one of said first position and said second position selectively.

4. A sheet object sorter for sorting sheet objects discharged from a main apparatus and taking in the sorted sheet objects into a plurality of bin units, according to claim 1, wherein the gate of each bin unit is physically connected to its bin unit and the gate extends substantially across the width of its bin unit.

5. A main image apparatus and a sorter comprising:

a plurality of bin units configured to be removably attached to a sidewall of said main apparatus;

when said bin units are attached to the sidewall of said main apparatus, a surface of a conveying path for the sheet objects is formed solely by a wall surface of the sidewall of said main apparatus to which said bin units are attached and an end portion of each of the bin units; and each of said bin units being capable of individual attachment and each includes a gate capable of selectively positioning to a first position and to a second position for taking in the sheet objects being conveyed on said conveying path, wherein when said gate positions at said first position, said conveying path is blocked to guide sheet objects being conveyed on said conveying path into each bin unit, and when said gate positions at said second position, said conveying path is opened to allow sheet-objects being conveyed on the conveying path to pass by, wherein each of said bin units being capable of individual attachment and each includes a driven conveyor roller at an end portion thereof, said main apparatus has a driving conveyor roller on the sidewall thereof, said driving conveyor roller contacting with said driven conveyor roller provided at each bin unit when said bin unit assembly is attached to said main apparatus; and sheet objects are conveyed while being caught between said driving conveyor roller and said driven conveyor roller.

6. The main apparatus and sorter as set forth in claim 5, wherein:

said driven conveyor roller and said driving conveyor roller includes at least one pair, respectively; and said at least one pair of driven conveyor rollers and said one pair of driving conveyor rollers having a space set equal to or smaller than a width of a sheet object of a minimum size to be discharged from said main apparatus, respectively.

7. A discharged paper processing device for image-forming apparatus for sorting paper sheets discharged from said image-forming apparatus and taking in the sorted paper sheets into a plurality of bin units, comprising:

a stack of said plurality of bin units removably attached to a sidewall of said image-forming apparatus;

when said bin units are attached to the sidewall of said image-forming apparatus, a surface of a conveying path for discharged paper sheets is formed solely by a wall surface of the sidewall of said image-forming apparatus to which said bin units are attached and an end portion of each of the bin units; and each of said bin units being capable of individual attachment and each includes a gate capable of selectively positioning to a first position and to a second position for taking in the discharged paper sheets being conveyed on said conveying path, wherein when said gate positions at said first position, said conveying path is blocked to guide discharged paper sheets being conveyed on said conveying path into each bin unit, and when said gate positions at said second position, said conveying path is opened to allow discharged paper sheets being conveyed on the conveying path to pass by.

8. The discharged paper processing device for image-forming apparatus as set forth in claim 7, wherein said bin units each comprises a tray for receiving discharged paper sheets, and a conveyor roller for conveying discharged paper sheets guided by said gate provided at each bin unit to said tray.

9. The discharged paper processing device for image-forming apparatus as set forth in claim 7, wherein said bin units each comprises a driving unit controlled so as to cause said gate to be positioned in one of said first position and said second position selectively.

10. A discharged paper processing device for image-forming apparatus for sorting paper sheets discharged from said image-forming apparatus and taking in the sorted paper sheets into a plurality of bin units according to claim 7, wherein the gate of each bin unit is physically connected to its bin unit and the gate extends substantially across the width of its bin unit.

11. An image-forming apparatus and sorter comprising: a plurality of bin units is configured to be removably attached to a sidewall of said image-forming apparatus;

when said bin units are attached to the sidewall of said image-forming apparatus, a surface of a conveying path for discharged paper sheets is formed solely by a wall surface of the sidewall of said image-forming apparatus to which said bin units are attached and an end portion of each of the bin units; and each of said bin units being capable of individual attachment and each includes a gate capable of selectively positioning to a first position and to a second position for taking in the discharged paper sheets being conveyed on said conveying path, wherein when said gate positions at said first position, said conveying path is blocked to guide discharged paper sheets being conveyed on said conveying path into each bin unit, and when said gate positions at said second position, said conveying path is opened to allow discharged paper sheets being conveyed on the conveying path to pass by, each of said bin units being capable of individual attachment and each includes a driven conveyor roller at an end portion thereof, said image-forming apparatus has a driving conveyor roller on the sidewall thereof, said driving conveyor roller contacting with said driven conveyor roller provided at each said bin unit when said bin units are attached to said-image forming apparatus; and discharged paper sheets are conveyed while being caught between said driving conveyor roller and said driven conveyor roller.

12. The image-forming apparatus and sorter as set forth in claim 11, wherein:

said driven conveyor roller and said driving conveyor roller comprises at least one pair, respectively; and said at least one pair of driven conveyor rollers and said one pair of driving conveyor rollers having a space set equal to or smaller than the a width of a paper sheet of a minimum size to be discharged from said image-forming apparatus, respectively.

13. The image forming apparatus and sorter according to claim 11, wherein the gate of each bin unit is physically connected to its bin unit and the gate extends substantially across the width of its bin unit.

14. A main image apparatus and a sorter comprising:

a plurality of bin units configured to be removably attached to a sidewall of said main apparatus;

when said bin units are attached to the sidewall of said main apparatus, a surface of a conveying path for the sheet objects is formed solely by a wall surface of the sidewall of said main apparatus to which said bin units are attached and an end portion of each of the bin units; and each of said bin units being capable of individual attachment and each includes a gate capable of selectively positioning to a first position and to a second position for taking in the sheet objects being conveyed on said conveying path, wherein when said gate positions at said first position, said conveying path is blocked to guide sheet objects being conveyed on said conveying path into each bin unit, and when said gate positions at said second position, said conveying path is opened to allow sheet-objects being conveyed on the conveying path to pass by, wherein dent portions into which a front edge portion of said gate provided at each of said bin units is put are formed on a sidewall of said main apparatus so that a front edge portion of said gate is put into a sidewall of said conveying path on said main apparatus side when said gate positions at said first position.

15. A main image apparatus and a sorter according to claim 14, wherein the gate of each bin unit is physically connected to its bin unit and the gate extends substantially across the width of its bin unit.

16. An image forming apparatus and sorter comprising:

a plurality of bin units is configured to be removably attached to a sidewall of said image-forming apparatus;

when said bin units are attached to the sidewall of said image-forming apparatus, a surface of a conveying path for discharged paper sheets is formed solely by a wall surface of the sidewall of said image-forming apparatus to which said bin units are attached and an end portion of each of the bin units; and each of said bin units being capable of individual attachment and each includes a gate capable of selectively positioning to a first position and to a second position for taking in the discharged paper sheets being conveyed on said conveying path, wherein when said gate positions at said first position, said conveying path is blocked to guide discharged paper sheets being conveyed on said conveying path into each bin unit, and when said gate positions at said second position, said conveying path is opened to allow discharged paper sheets being conveyed on the conveying path to pass by, wherein dent portions into which a front edge portion of said gate provided at each of said bin units is put are formed on a sidewall of said image-forming apparatus so that a front edge portion of said gate is put into a sidewall of said conveying path on said image-forming apparatus side when said gate positions at said first position.

17. The image forming apparatus and sorter according to claim 16, wherein the gate of each bin unit is physically connected to its bin unit and the gate extends substantially across the width of its bin unit.

* * * * *